US005271719A

United States Patent [19]

Abe et al.

[11] Patent Number: 5,271,719

[45] Date of Patent: Dec. 21, 1993

[54] FLUID ROTATING APPARATUS AND METHOD OF CONTROLLING THE SAME

[75] Inventors: Yoshikazu Abe, Neyagawa; Teruo Maruyama, Hirakata; Akira Takara, Moriguchi, all of Japan

[73] Assignee: Matsushita Electric Industrial Co., Ltd., Osaka, Japan

[21] Appl. No.: 903,322

[22] Filed: Jun. 24, 1992

[30] Foreign Application Priority Data

Jun. 28, 1991 [JP] Japan ..... 3-158512

[51] Int. Cl.[5] ..... F04C 18/16

[52] U.S. Cl. ..... 417/26; 417/42; 417/45; 417/205; 417/293

[58] Field of Search ..... 417/1, 42, 45, 201, 417/203, 205, 423.4, 26, 293; 418/201.1; 318/77, 85

[56] References Cited

U.S. PATENT DOCUMENTS

| | | | |
|---|---|---|---|
| Re. 17,689 | 6/1930 | Hibbard | 417/293 |
| 2,640,428 | 6/1953 | Houghton . | |
| 4,712,048 | 12/1987 | Rebsamen . | |
| 4,758,132 | 4/1988 | Hartwig . | |
| 4,797,068 | 1/1989 | Hayakawa et al. . | |
| 4,808,077 | 2/1989 | Kan et al. . | |
| 4,850,806 | 7/1989 | Morgan et al. | 417/205 |
| 5,062,771 | 11/1991 | Satou et al. | 417/45 |

FOREIGN PATENT DOCUMENTS

| | | |
|---|---|---|
| 0230868 | 8/1987 | European Pat. Off. . |
| 60-259791 | 12/1985 | Japan . |
| 809445 | 2/1959 | United Kingdom . |
| 2123089 | 1/1984 | United Kingdom . |

OTHER PUBLICATIONS

"A Generalized Performance Computer Program for Oil Flooded Twin-Screw Compressor", Pawan J. Singh and Ghanshyam C. Patel, Ingersoll-Rand Research, Inc. Princeton, N.J., 1984, pp. 544-553.

"Computer Modeling for Performance Analysis of Rotary Screw Compressor", Mitsuru Fujiwara and Katsuhiko Kasuya, Mechanical Engineering Research Laboratory, Hitachi, Ltd., Ibaraki, Japan, 1984, pp. 536-543.

"A New Molecular Pump", Louis Maurice, Proc. 6th Interl. Vacuum Congr. 1974 Japan, J. Appl. Phys. Suppl. 2, Pt. 1, 1974.

*Primary Examiner*—Richard A. Bertsch
*Assistant Examiner*—David W. Scheuermann
*Attorney, Agent, or Firm*—Wenderoth, Lind & Ponack

[57] ABSTRACT

A fluid rotating apparatus of a positive displacement pump includes a plurality of rotors accommodated in a housing, a bearing for rotatably supporting the rotors, a suction port and a discharge port formed in the housing, a suction chamber and a discharge chamber in the housing respectively communicating with the suction port and the discharge port, a plurality of motors for individually rotating the rotors, and a detecting device for detecting rotating angles and rotating numbers of the motors. In the apparatus, a fluid is sucked and discharged due to capacity change of a space defined by the rotors and the housing through synchronous control of the rotation of the plurality of motors by a signal from the detecting device. The housing has a communicating path with a flow control device to make an upstream side communicate with a downstream side of the apparatus when the rotational numbers of the rotors are less than a predetermined value. A method of controlling the apparatus includes the steps of opening the communicating path by operating the flow control device to cause the upstream side to communicate with the downstream side of the apparatus when the rotational numbers of the rotors are less than a predetermined value, and closing the communicating path by operating the flow control device when the rotational numbers of the rotors are not less than a predetermined value.

4 Claims, 7 Drawing Sheets

Fig. 11 - PRIOR ART
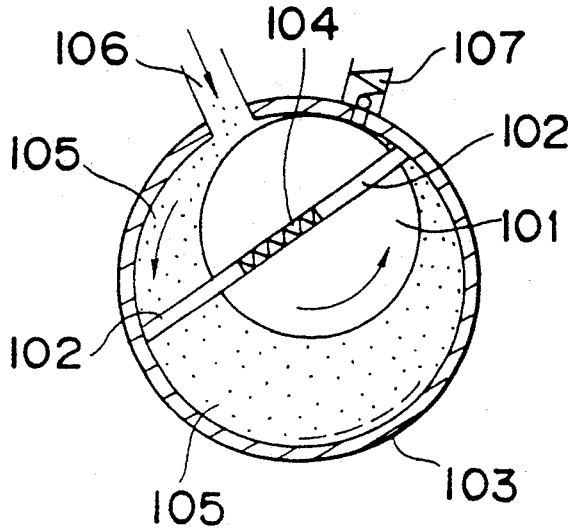
Fig. 12 - PRIOR ART
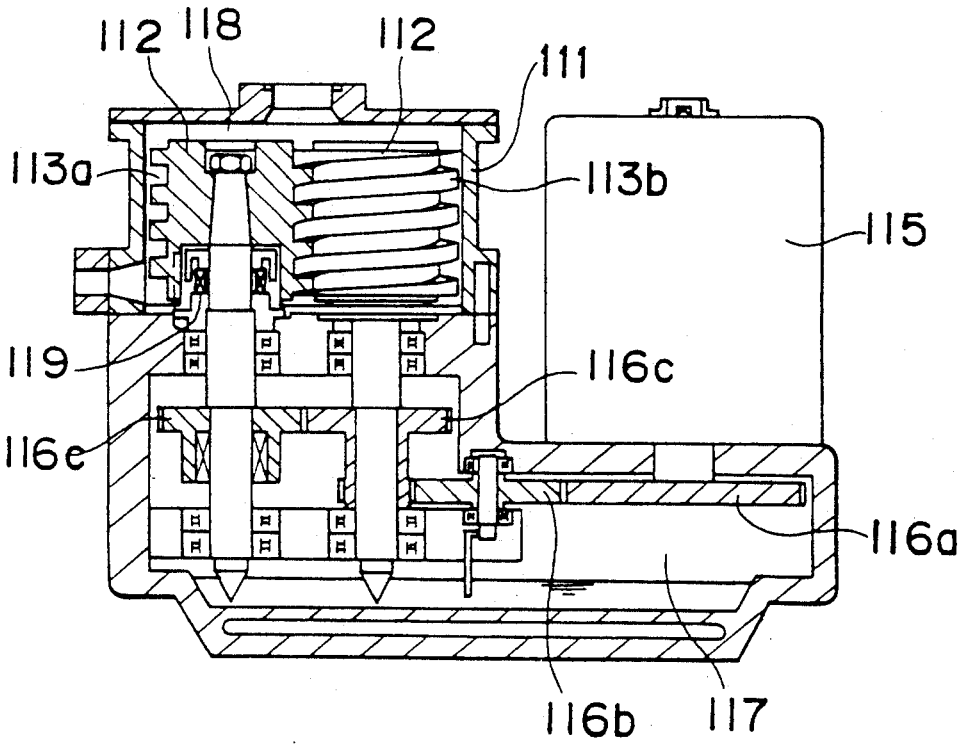

FLUID ROTATING APPARATUS AND METHOD OF CONTROLLING THE SAME

BACKGROUND OF THE INVENTION

The present invention relates to a fluid rotating apparatus such as a vacuum pump, a compressor or the like, and a method of controlling the apparatus.

FIG. 11 shows an example of a conventional sliding vane vacuum pump provided with only one rotor. In the vacuum pump with one rotor, when a rotor 101 rotates, two blades 102 inserted into the rotor 101 in the diametrical direction of the rotor 101 are driven and rotated inside a cylindrical fixed wall 103 (stator). At this time, the leading ends of the blades 102 are kept in contact with the fixed wall since the blades 102 are always urged in the radial direction of the rotor 101 by the action of a spring 104. Subsequent to the rotation, the capacity of each of the spaces 105 partitioned by the blades 102 in the fixed wall is changed, and a gas entering from a suction port 106 formed in the fixed wall is eventually sucked and compressed and flows out through a discharge port 107 having a discharge valve. In the vacuum pump of this type, in order to prevent internal leakage, it is necessary to seal the side surface and the leading ends of the blades 102, the side surface of the fixed wall 103, and the side surface of the rotor 101 with an oil membrane, respectively. However, when this kind of vacuum pump is used in the manufacturing process of semiconductors, e.g., CVD or dry etching, etc. using a highly corrosive reactive gas such as chlorine gas, the gas reacts with the sealing oil to thereby generate a reaction product in the pump. In such case as above, it becomes necessary to perform maintenance work frequently so as to remove the reaction product, and moreover the pump should be cleaned and the oil should be exchanged every time maintenance work is performed, thus bringing the manufacturing process to a halt. The activity rate is hence decreased. So long as the sealing oil is used in the vacuum pump, the oil is scattered from the downstream side to the upstream side, polluting the vacuum chamber and reducing the manufacturing efficiency.

In view of the above-described inconveniences, a positive displacement screw vacuum pump has been developed and put into practical use as a dry pump not requiring the sealing oil. FIG. 12 is a side sectional view of an example of the screw vacuum pump. Within a housing 111 are provided two rotors 112, the rotary shafts of which are made parallel to each other. Spiral grooves are formed on the peripheral surfaces of the rotors 112. A space is defined when a recess portion (groove) 113*a* of one rotor and a projection 113*b* of the other rotor are meshed with each other. As the rotors 112 rotate, the capacity of the space is changed, thereby causing sucking/discharging of the fluid.

In the conventional positive displacement screw vacuum pump referred to above, the synchronous rotation of the rotors 112 is achieved by timing gears. That is, the rotation of a motor 115 is transmitted from a driving gear 116*a* to an intermediate gear 116*b* and further to one of the meshed timing gears 116*c* of the rotors 112. The phase of the rotating angles of both rotors 112 is adjusted by the engagement between the two timing gears 116*c*. Therefore, since the screw vacuum pump uses the gears both for transmission of the motor power and for synchronous rotation of the rotors as described hereinabove, a lubricating oil filled in a machine chamber 117 which houses the gears must be supplied to the gears. Moreover, a mechanical seal 119 should be provided between the machine chamber 117 and a fluid chamber 118 so as to prevent the lubricating oil from entering the chamber 118 where the rotors are accommodated.

The vacuum pump with two rotors in the above-described construction has such disadvantages yet to be solved that (1) many gears are required for the power transmission and the synchronous rotation, i.e., many parts are required, resulting in a complicated structure of the apparatus (2) a high speed operation cannot be expected and the apparatus becomes bulky in size since the rotors are synchronously rotated with contact between the gears, (3) a mechanical seal must be regularly exchanged due to the abrasion thereof, failing to realize a completely maintenance-free pump, (4) a large sliding torque due to the mechanical seal induces a great mechanical loss, and so on.

SUMMARY OF THE INVENTION

The inventors of the present invention have already proposed a positive displacement vacuum pump which is provided with a plurality of rotors driven by independent motors, wherein the rotation of the plurality of rotors is synchronously controlled without contact by use of a detecting means, e.g., a rotary encoder which detects the rotating angle and rotating number of the motors.

A vacuum pump capable of driving rotors at high speeds and which can be easily cleaned and miniaturized without requiring maintenance work is realized from the above proposal.

An object of the present invention is to provide a further improved vacuum pump having increased durability and reliability without reducing the discharging efficiency over a wide range of suction pressures, while making the motors compact in size.

In accomplishing these and other objects, according to one aspect of the present invention, there is provided a fluid rotating apparatus of a positive displacement pump which comprises:

a plurality of rotors accommodated in a housing;

a bearing for rotatably supporting the rotors;

a suction port and a discharge port formed in the housing;

a suction chamber and a discharge chamber in the housing respectively communicating with the suction port and the discharge port;

a plurality of motors for individually rotating the rotors; and a detecting means for detecting rotating angles and rotating numbers of the motors, wherein a fluid is sucked and discharged due to capacity change of a space defined by the rotors and the housing through synchronous control of rotation of the plurality of motors by a signal from the detecting means, characterized in that the housing has a communicating path with a flow control means to make an upstream side communicate with a downstream side of the apparatus when the rotational numbers of the rotors are less than a predetermined value.

According to another aspect of the present invention, there is provided a method of controlling a fluid rotating apparatus of a positive displacement pump which comprises: a plurality of rotors accommodated in a housing; a bearing for rotatbly supporting the rotors; a suction port and a discharge port formed in the housing; a suction chamber and a discharge chamber in the housing respectively communicating with the suction port and the discharge port; a plurality of motors for individually rotating the rotors; and a detecting means for detecting rotating angles and rotating numbers of the motors, the housing having a communicating path with a flow control means to make an upstream side communicate with a downstream side of the apparatus, wherein a fluid is sucked and discharged due to capacity change of a space defined by the rotors and the housing through synchronous control of rotation of the plurality of motors by a signal from the detecting means, characterized in that the method comprises the steps of:

opening the communicating path by operation of the flow control means to cause the upstream side to communicate with the downstream side of the apparatus when the rotational numbers of the rotors are less than a predetermined value; and closing the communicating path by operating the flow control means when the rotational numbers of the rotors are not less than a predetermined value.

Since a plurality of rotors are driven by the respective independent motors, and the synchronous rotation of the rotors is controlled in a non-contact manner, it becomes unnecessary to provide gears for the purpose of the synchronous rotation and the transmission of power. Accordingly, it is not necessary to supply lubricating oil to the gears, and the apparatus can be easily driven at high speeds. When the present invention is applied to a positive displacement vacuum pump with a flow control means provided for a communicating path which communicates the upstream side of the pump with the downstream side, the communicating path is opened by the flow control means to make the upstream side communicate with the downstream side when the pump is activated and the rotational numbers of the rotors are less than a predetermined value. Thereafter, the communicating path is closed to thereby suck/discharge the fluid when the rotating numbers of the motors are not less than the predetermined value. Accordingly, the unstable state of the synchronous control accompanying the change of the load when the pump is activated is eliminated, thus enhancing the durability and reliability of the pump. Moreover, the motors can be made compact in size because of the suppressed load change during the high speed driving time and without influences of a large torque at start-up.

In the case where the positive displacement vacuum pump is of a screw type, the fluid runs approximately continuously, so that the internal leakage is restricted and a large space is secured for the rotors and utilized as a housing to accommodate bearings, motors, etc. Accordingly, the apparatus has a compact construction.

BRIEF DESCRIPTION OF THE DRAWINGS

These and other objects and features of the present invention will become apparent from the following description taken in conjunction with the preferred embodiments thereof with reference to the accompanying drawings, in which:

FIG. 11 is a top sectional view of a first conventional arrangement; and

FIG. 12 is a side sectional view of a second conventional arrangement.

DETAILED DESCRIPTION OF THE PREFERRED EMBODIMENTS

Figure 1:
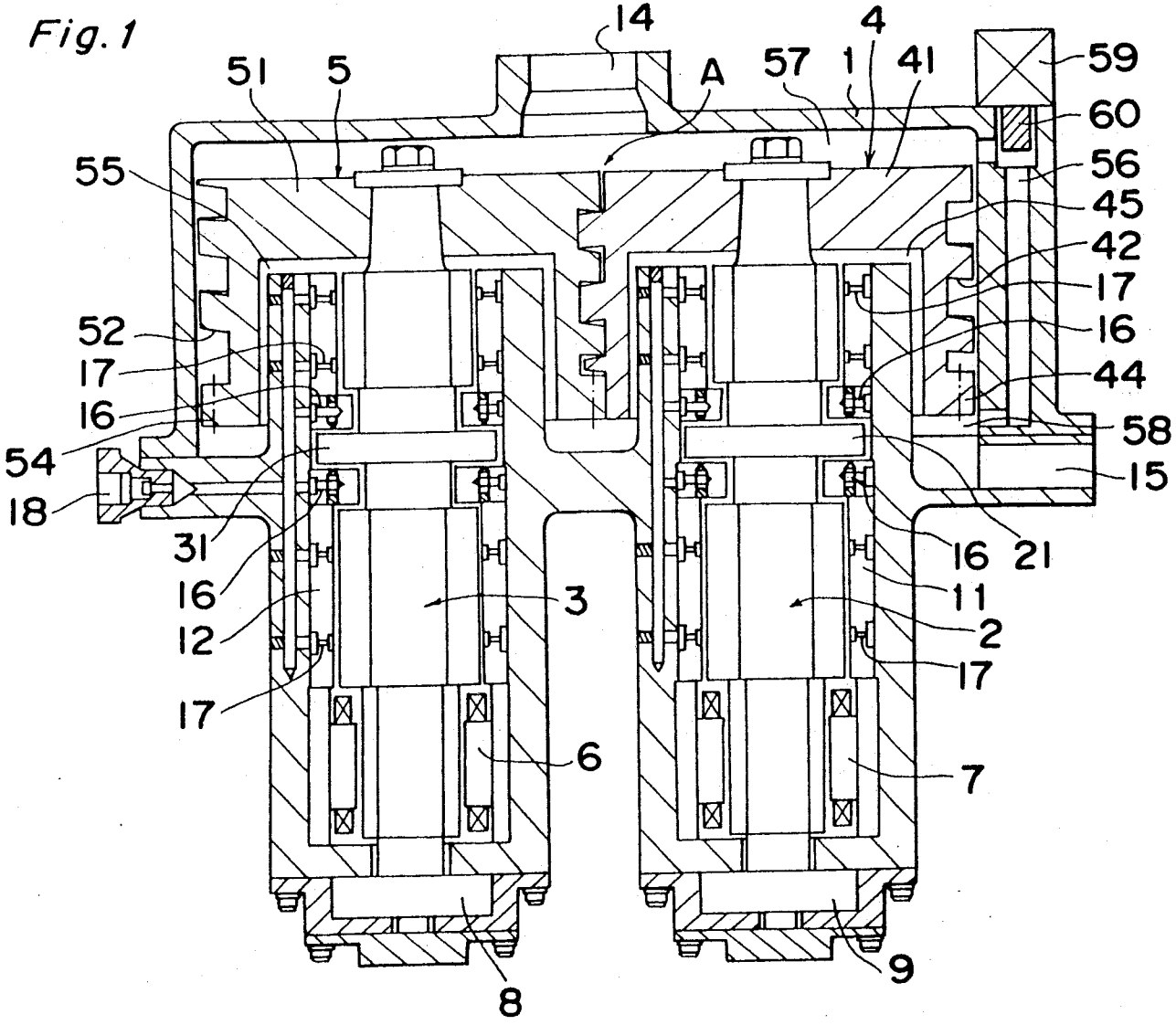
FIG. 1 is a cross sectional view showing a fluid rotating apparatus according to a first embodiment of the present invention.

Before the description of the present invention proceeds, it is to be noted that like parts are designated by like reference numerals throughout the accompanying drawings.

FIG. 1 illustrates a positive displacement vacuum pump as a first embodiment of a fluid rotating apparatus according to the present invention. The vacuum pump has a first bearing chamber 11 accommodating a first rotary shaft 2 in a vertical direction within a housing 1 and a second bearing chamber 12 accommodating a second rotary shaft 3 in the same vertical direction. Cylindrical rotors 4 and 5 are fitted from outside at the upper ends of the rotary shafts 2 and 3. Spiral grooves 42 and 52 are formed at the outer peripheral surfaces of the rotors 4 and 5 in a manner to be meshed with each other. The section defined when the spiral grooves are meshed constitutes a first structural part A of the positive displacement vacuum pump. That is, a space defined by a recessed portion (groove) and a projecting portion of the engaged spiral grooves 42 and 52, and the housing 1 periodically changes its capacity in accordance with the rotation of the rotary shafts 2 and 3, thereby acting to suck/discharge the fluid.

Figure 2:
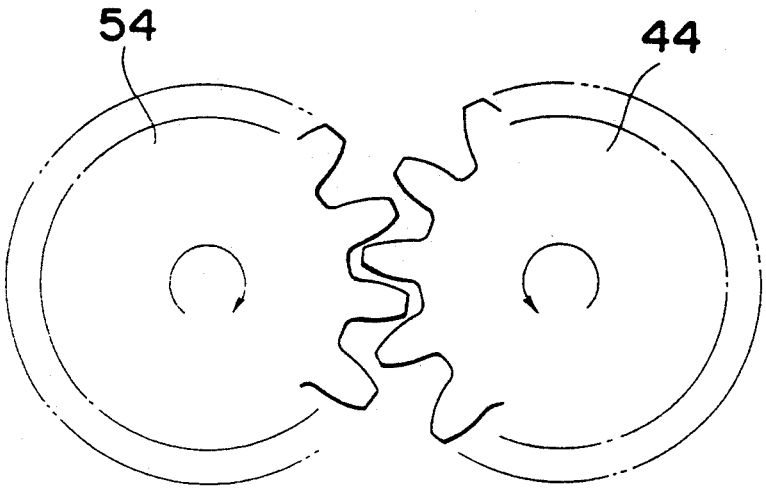
FIG. 2 is a plan view of a contact preventing gear used in the first embodiment.

There are contact preventing gears 44 and 54 as shown in FIG. 2 so as to prevent contact between the spiral grooves 42 and 52 on the outer peripheral surfaces at the lower ends of the rotors 4 and 5, respectively. A solid lubricating film is formed for each contact preventing gear 44 and 54 to withstand some metallic contact. A gap (backlash) $\delta_2$ formed when the contact preventing gears 44 and 54 are meshed with each other is set smaller than a gap (backlash) $\delta_1$ between the spiral grooves on the outer peripheral surfaces of the rotors 4 and 5. Therefore, when the rotary shafts 2 and 3 are rotated smoothly and synchronously, the contact preventing gears 44 and 54 are never brought in touch with each other. However, if the synchronous rotation of the rotary shafts 2 and 3 is broken, the contact preventing gears 44 and 54 are turned in contact with each other before the spiral grooves 42 and 52 contact with each other, thereby preventing contact and collision between the spiral grooves 42 and 52. If the backlashes $\delta_1$ and $\delta_2$ are set minute, it may be feared that it is difficult to process the members of the apparatus accurately at a useful level. However, the total leaking amount of the fluid in one stroke of the pump is proportional to the time period of the one stroke, and therefore, the performance of the pump (ultimate degree of vacuum) can be sufficiently maintained even if the backlash $\delta_1$ between the spiral grooves 42 and 52 is increased a little so long as the rotary shafts 2 and 3 are rotated at high speeds. Accordingly, in the vacuum pump of the embodiment wherein the rotary shafts 2 and 3 are rotated at high speeds, the backlashes $\delta_1$ and $\delta_2$ of the size required to prevent the collision of the spiral grooves 42 and 52 can be securely obtained with the normal processing accuracy.

In the housing 1, a suction port 14 is provided at the upstream side of the first structure part A of the positive displacement vacuum pump and a discharge port 15 is provided at the downstream side thereof.

The first rotary shaft 2 and the second rotary shaft 3 are supported by non-contact type (contactless) hydrostatic bearings provided in the internal spaces 45 and 55 of the cylindrical rotors 4 and 5. More specifically, thrust bearings are constituted by supplying a compressed gas to the upper and lower surfaces of disk-like parts 21, 31 of the rotary shafts 2 and 3 from orifices 16. On the other hand, radial bearings are constituted by supplying a compressed gas to the outer peripheral surfaces of the rotary shafts 2 and 3 from orifices 17. In this case, when clean nitrogen gas generally kept in semiconductor plants is used as the compressed gas, the pressure inside the internal spaces 45 and 55 accommodating the motors 6 and 7 can be made higher than the atmospheric pressure, whereby a reactive gas which is corrosive and liable to produce deposit is prevented from entering the internal spaces 45 and 55.

The bearings may be magnetic bearings instead of the hydrostatic bearings as above, and since the magnetic bearings are contactless like the hydrostatic bearings, a high speed rotation can be easily achieved and a completely oil-free construction can be realized. When a ball bearing is used in the bearing and a lubricating oil is used for lubrication of the bearing, it is possible to prevent the lubricating oil from entering the fluid operation chamber by use of the gas purge mechanism utilizing the nitrogen gas.

The first rotary shaft 2 and the second rotary shaft 3 are rotated at high speeds of tens of thousands of revolutions per minute by the AC servo-motors 6 and 7 provided in the lower part of the respective shafts.

Figure 3:
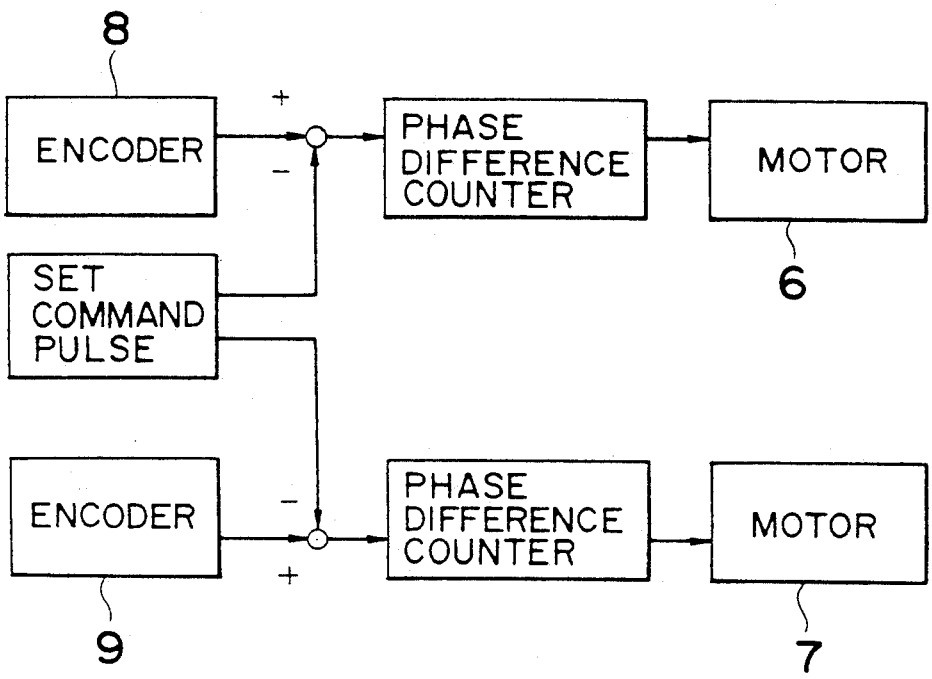
FIG. 3 is a block diagram showing a method of synchronous control.

According to the instant embodiment, the two rotary shafts are controlled to be synchronously rotated in a manner as depicted by a block diagram of FIG. 3. In other words, there are provided rotary encoders 8 and 9 at the lower ends of the rotary shafts 2 and 3, as is clear from FIG. 1. The output pulses from the rotary encoders 8 and 9 are compared with command pulses (target values) set for a virtual rotor, and the deviation between the target value and each output value (rotational number, rotational angle) from the shafts 2 and 3 is processed by a phase difference counter. In consequence, the rotation of the servo motors 6 and 7 is controlled to remove this deviation.

Figure 4:
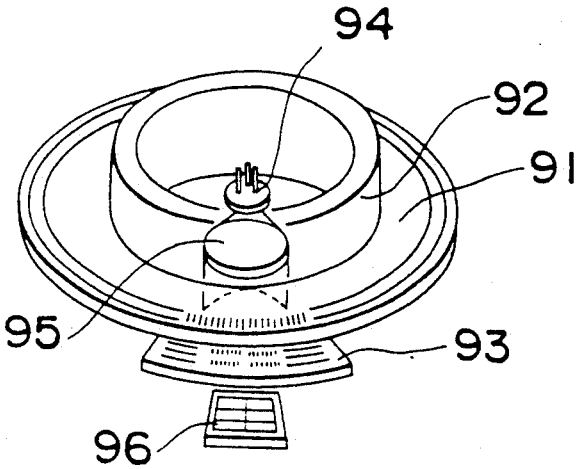
FIG. 4 is a perspective view showing a laser encoder used in the first embodiment.

A magnetic encoder or a general optical encoder may be used as the above rotary encoder. A laser type encoder of a high resolution and a high speed response utilizing the diffraction/interference of laser beams is used in the instant embodiment. FIG. 4 shows an example of the laser type encoder. In FIG. 4, reference numeral 91 represents a moving slit plate having many slits arranged into the shape of a circle. The moving slit plate 91 is rotated by a shaft 92 such as the first rotary shaft 2 or the second rotary shaft 3. Reference numeral 93 indicates a fixed slit plate, opposed to the moving slit plate 91, where slits are arranged in the configuration of a fan. The light emitted from a laser diode 94 passes through each slit of the, slit plates 91 and 93, through a collimator lens 95, and is received by a light receiving element 96.

Referring back to FIG. 1, a suction chamber 57 is communicated with a discharge chamber 58 via a bypass 56 of the housing 1. An electromagnetic valve 59 in the middle of the bypass 56 works to open/close the bypass 56 with a piston 60.

In the fluid rotating apparatus of the structure described hereinabove, the first and second rotary shafts 2 and 3 are synchronously activated by the independent servo-motors 6 and 7 at high speeds up to tens of thousands of rpm, such as twenty thousand rpm. At this starting time, the piston 60 of the electromagnetic valve 59 is raised to open the bypass 56, so that the suction chamber 57 and the discharge chamber 58 are communicated with each other, without the fluid being sucked/discharged by the rotors 4 and 5. Therefore, while the rotational number is being increased at the start of rotation of the rotary shafts 2 and 3, the load torque is not changed and the unstable state of the synchronous control is eliminated. Accordingly, a predetermined rotational number can be obtained smoothly. When the rotational number reaches the predetermined value, the bypass 56 is closed by the piston 60 of the electromagnetic valve 59, and the capacity of the space between the housing 1 and the outer peripheral surfaces of the rotors 4 and 5 and is changed. In consequence, the fluid is sucked/discharged.

As is described hereinabove, according to the present embodiment, the suction chamber and the discharge chamber are communicated with each other through the bypass in which the electromagnetic valve is installed when the synchronous control of the rotary shafts is instable at the start time of the rotation. Therefore, the unstable state of the synchronous control is solved, and the durability and reliability of the apparatus is enhanced. Since the load torque is small during the high speed rotation without the influence of a large start-up torque, the servo-motors can be made compact in size.

Figure 5A:
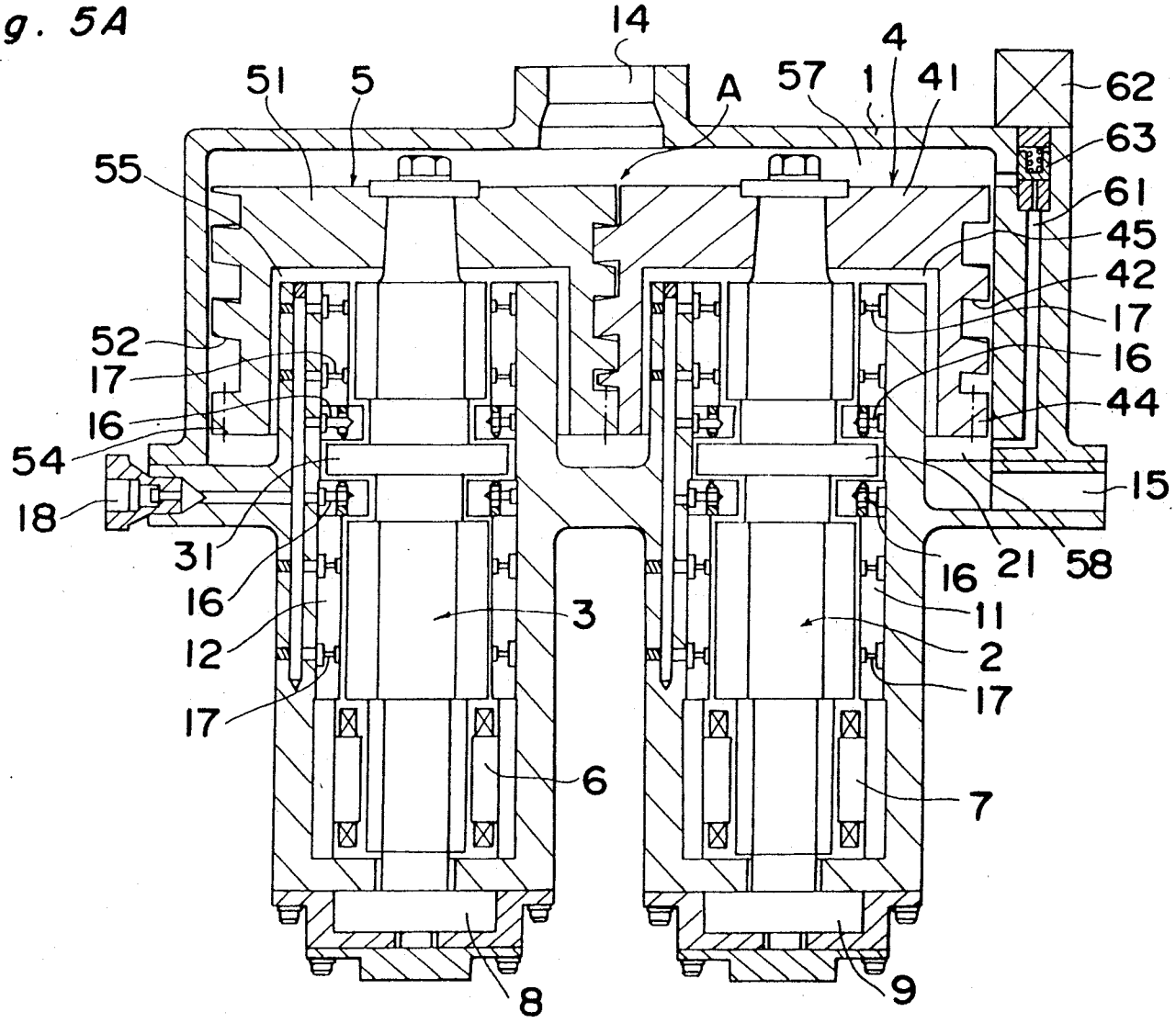
FIG. 5A is a cross sectional view of a fluid rotating apparatus according to a second embodiment of the present invention.
Figure 5B:
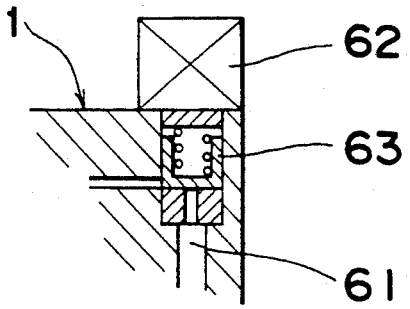
FIGS. 5B and 5C are enlarged cross sectional views of a duty control valve in the second embodiment under closed and opened conditions.
Figure 5C:
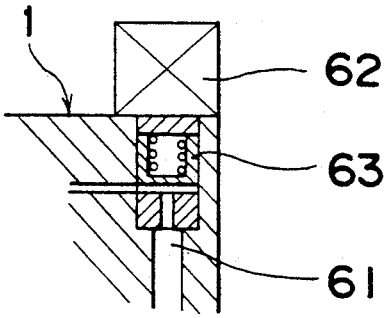

FIGS. 5A, 5B, and 5C show a fluid rotating apparatus according to a second embodiment of the present invention, which is different from FIG. 1 in that a control path 61 connecting the suction chamber 57 with the discharge chamber 58 is formed in the housing 1 and provided with a duty control valve 62.

In the above-described construction, a plunger 63 of the duty control valve 62 can be finely actuated by a pulse signal based on the change of the current, to thereby close or open the control path 61 connecting the suction chamber 57 with the discharge chamber 58 as shown in FIGS. 5B and 5C. The pressure of the fluid at the upstream side is controlled such that it is held at a predetermined value. Therefore, it is possible to maintain constant the pressure within a vacuum chamber using the vacuum pump, without requiring a flow control valve for controlling the inflow amount of a gas used for the process in the vacuum chamber. As a result, the vacuum discharge system is simplified, and casts are reduced.

According to the above first and second embodiments, the suction chamber is communicated with the discharge chamber via the bypass and control paths. However, it is enough that the upstream side where the fluid enters and the downstream side from where the fluid flows out are communicated with each other. For example, the same effect as above can be obtained even if a communicating path is formed between the suction chamber and the atmospheric side, or between the space between the rotors and housing and the discharge chamber, or between the suction port 14 and the discharge port 15, or between the spiral groove 42 and the discharge chamber 58.

Figure 6:
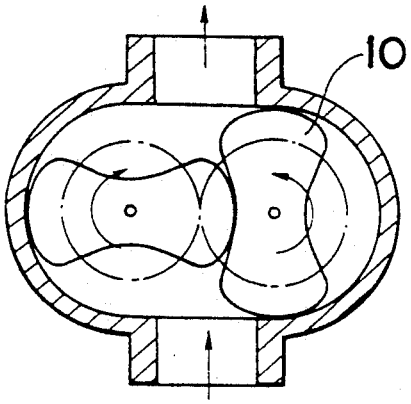
FIG. 6 is a schematic view of a rotor of a different model to be used in the present invention.
Figure 8A:
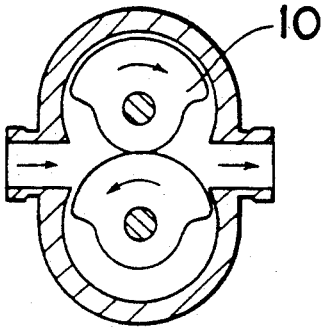
FIGS. 8A and 8B are schematic views of rotors of still different models to be used in the present invention.
Figure 7:
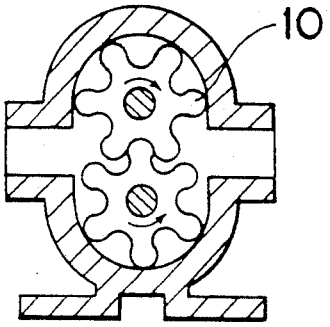
FIG. 7 is a schematic view of a rotor of a further different model to be used in the present invention.
Figure 8B:
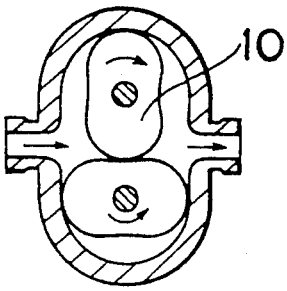
Figure 9:
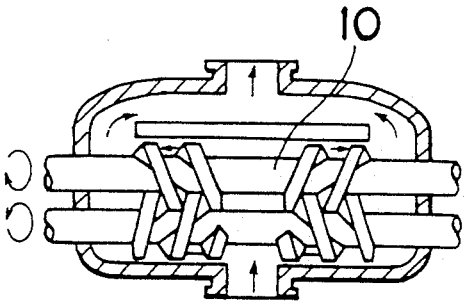
FIG. 9 is a schematic view of a rotor of a yet different model to be used in the present invention.
Figure 10:
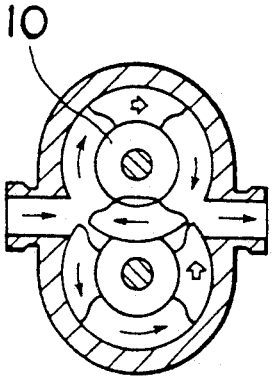
FIG. 10 is a schematic view of a rotor of a yet further model to be used in the present invention.

The fluid rotating apparatus embodied by the present invention may be a compressor for air conditioning. In this case, a rotor 10 of the rotary section of the compressor may be a Roots-type as indicated in FIG. 6, a gear-type of FIG. 7, a single or double lobe-type of FIGS. 8A and 8B, a screw-type of FIG. 9 or an outer peripheral piston-type of FIG. 10, etc.

Since the synchronous rotation of the rotors is electronically controlled in a non-contact manner according to the present invention, a timing gear used in a conventional screw pump or the like is dispensed with. Moreover, since the rotors are driven separately by independent motors, the power transmission by a gear is not required. Meanwhile, it is necessary to form a space which undergoes a change in capacity by the relative movement of two or more rotors in a positive displacement pump or compressor. Therefore, in the prior art, the two or more rotors are synchronously rotated by a transmission gear, a timing gear, or a complicated transmission mechanism employing a link and a cam mechanism. Although it is possible to rotate the rotors at some high speeds if a lubricating oil is supplied to the timing gear or transmission mechanism, the upper limit of the rotating number is ten thousand rpm at most when the vibration, noises, and reliability of the apparatus are taken into consideration. In contrast, according to the present invention without requiring a complicated mechanism as in the prior art, the rotary section of the rotors can be rotated at such high speeds as not lower than ten thousand rpm, and moreover, the apparatus can be simplified since the transmission mechanism, etc. is omitted. At the same time, no oil seal is necessary and no loss of torque due to mechanical sliding is brought about, thus making it unnecessary to regularly replace the oil seal and oil. The power of the vacuum pump is a product of the torque and the rotating number, and therefore the torque can be reduced as the rotating number is increased. Accordingly, the torque can be lowered in the present invention since the rotors are rotated at high speeds, whereby the motor can be made compact. Besides, the rotors are driven by independent motors, and the torque for each motor can be further reduced. When each motor is built in the rotor as in the first embodiment, the apparatus can be compact in size and light in weight, and requires less space as a whole.

In the first embodiment, since the electromagnetic valve installed in the bypass which connects the suction chamber and the discharge chamber of the positive displacement pump opens/closes the bypass when the fluid rotating apparatus is started, the change of the load torque as the rotating number is being increased is restricted, and the synchronous control is prevented from becoming unstable. Therefore, the fluid rotating apparatus easily achieves the synchronous control at high speeds with high accuracy. Moreover, since the load torque at the driving time at high speeds is small, the motor can be made small.

In the second embodiment, the control path connecting the suction chamber with the discharge chamber is provided with the duty control valve, so that the pressure at the upstream side of the fluid is controlled. Therefore, the vacuum discharge system is simplified in structure and costs are reduced.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A fluid rotating apparatus of a positive displacement pump which comprises:

a plurality of rotors accommodated in a housing;

a bearing for rotatably supporting the rotors;

a suction port and a discharge port formed in the housing;

a suction chamber and a discharge chamber in the housing respectively communicating with the suction port and the discharge port;

a plurality of motors for individually rotating the rotors; and a detecting means for detecting rotating angles and rotating numbers of the motors, wherein a fluid is sucked and discharged due to a capacity change of a space defined by the rotors and the housing through synchronous control of rotation of the plurality of motors by a signal from the detecting means, characterized in that the housing has a communicating path with a flow control means to make an upstream side communicate with a downstream side of the apparatus when the rotational numbers of the rotors are less than a predetermined value.

2. The fluid rotating apparatus as claimed in claim 1, wherein the flow control means is provided with an electromagnetic valve for closing the communicating path when the rotational numbers of the rotors are not less than a predetermined value.

3. The fluid rotating apparatus as claimed in claim 1, wherein the flow control means is provided with a flow control valve for controlling flow rate of the fluid between the suction chamber and the discharge chamber.

4. A method of controlling a fluid rotating apparatus of a positive displacement pump which comprises: a plurality of rotors accommodated in a housing; a bearing for rotatably supporting the rotors; a suction port and a discharge port formed in the housing; a suction chamber and a discharge chamber in the housing respectively communicating with the suction port and the discharge port; a plurality of motors for individually rotating the rotors; and a detecting means for detecting rotating angles and rotating numbers of the motors, the housing having a communicating path with a flow control means to make an upstream side communicate with a downstream side of the apparatus, wherein a fluid is sucked and discharged due to capacity change of a space defined by the rotors and the housing through synchronous control of rotation of the plurality of motors by a signal from the detecting means, characterized in that the method comprises the steps of:

opening the communicating path by operating the flow control means to cause the upstream side to communicate with the downstream side of the apparatus when the rotational numbers of the rotors are less than a predetermined value; and closing the communicating path by operating the flow control means when the rotational numbers of the rotors are not less than a predetermined value.

* * * * *